US007321091B1

(12) United States Patent
Hsieh

(10) Patent No.: US 7,321,091 B1
(45) Date of Patent: Jan. 22, 2008

(54) SUPPORTING STAND FOR A CLARINET AND THE LIKE

(75) Inventor: Wu-Hong Hsieh, Lu Chou (TW)

(73) Assignee: K.H.S. Musical Instrument Co., Ltd., Lu Chou, Taipei Hsien (TW)

( * ) Notice: Subject to any disclaimer, the term of this patent is extended or adjusted under 35 U.S.C. 154(b) by 0 days.

(21) Appl. No.: 11/561,860

(22) Filed: Nov. 20, 2006

(51) Int. Cl.
*G10D 7/10* (2006.01)

(52) U.S. Cl. ..... 84/387 A

(58) Field of Classification Search ..... 84/453, 84/421, 387 A, 385 A; 47/40.5; 248/176.1, 248/166, 170, 168, 528, 173, 525, 150, 151, 248/460, 529, 443
See application file for complete search history.

(56) References Cited

U.S. PATENT DOCUMENTS 2,341,424 A * 2/1944 Chason ..... 223/120
3,637,070 A * 1/1972 Friedman ..... 206/314

* cited by examiner

*Primary Examiner*—Kimberly Lockett
(74) *Attorney, Agent, or Firm*—James H. Walters

(57) ABSTRACT

A supporting stand includes a base, a connection joint having a connection hole, a supporting rod connected to the connection joint, a compressible spring mounted on a free end of the supporting rod and a conical covering movably mounted on top of the supporting rod to sandwich the compressible spring therebetween such that the conical covering is able to adapt to and extend into musical instrument of different dimensions.

3 Claims, 4 Drawing Sheets

SUPPORTING STAND FOR A CLARINET AND THE LIKE

BACKGROUND OF THE INVENTION

1. Field of the Invention

The present invention relates to a supporting stand, and more particularly to a supporting stand for a clarinet to provide sufficient supporting force regardless of the dimension of the clarinet.

2. Description of the Prior Art

After performance, the musician often stores the musical instrument, especially the clarinet, in a specially made box for storage and transportation. When the musical instrument is placed inside the box, it means that the musical instrument is to be stored inside the box for at least a period of time. However, when the musician only needs a temporary stand to support the musical instrument during the intermission, different stands are prepared to adapt to dimensions of the musical instruments. However, preparing different stands for each of the musical instruments of different dimensions takes a lot of spaces and very tiresome for the musicians.

In order to overcome the drawback, a new type of stand is introduced to the market, which is able to adapt to clarinet and the like of different dimensions.

Still, due to each clarinet and the like having a specific depth, the improved stand may not be able to provide the necessary support to clarinet of a specific dimension.

To overcome the shortcomings, the present invention tends to provide an improved supporting stand to mitigate the aforementioned problems.

SUMMARY OF THE INVENTION

The primary objective of the present invention is to provide an improved supporting stand for clarinets of different dimensions to provide sufficient supporting force thereto.

In order to accomplish the foregoing objective, the supporting stand has a compressible spring sandwiched between a supporting rod and a conical covering. With the provision of the compressible spring, the conical covering is able to move relative to the supporting rod such that the supporting stand can be snugly fitted into a clarinet having a specific dimension and provide sufficient supporting force to the clarinet.

Other objects, advantages and novel features of the invention will become more apparent from the following detailed description when taken in conjunction with the accompanying drawings.

DETAILED DESCRIPTION OF THE PREFERRED EMBODIMENT

Figure 1:
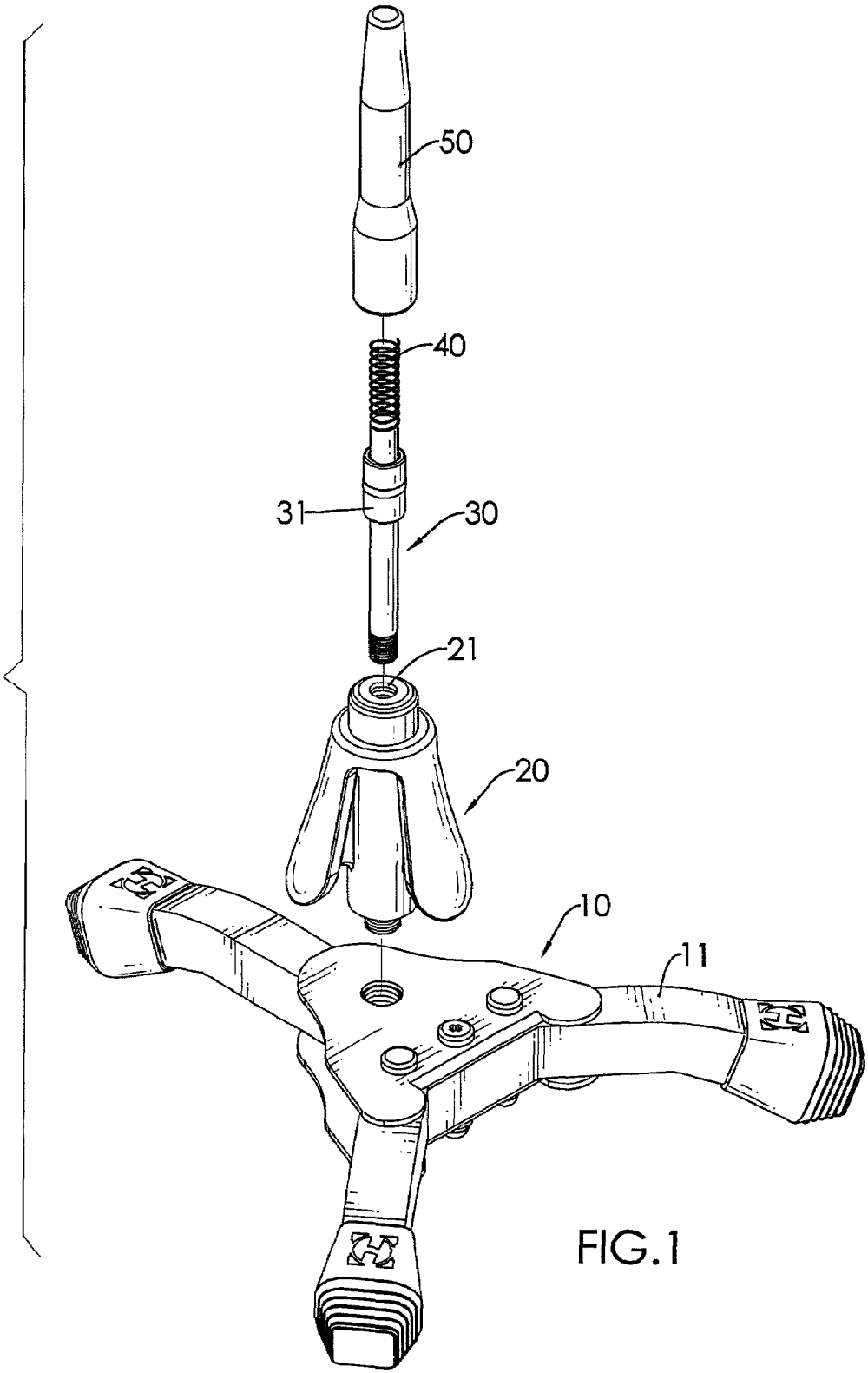
FIG. 1 is an exploded perspective view of the supporting stand of the present invention.
Figure 2:
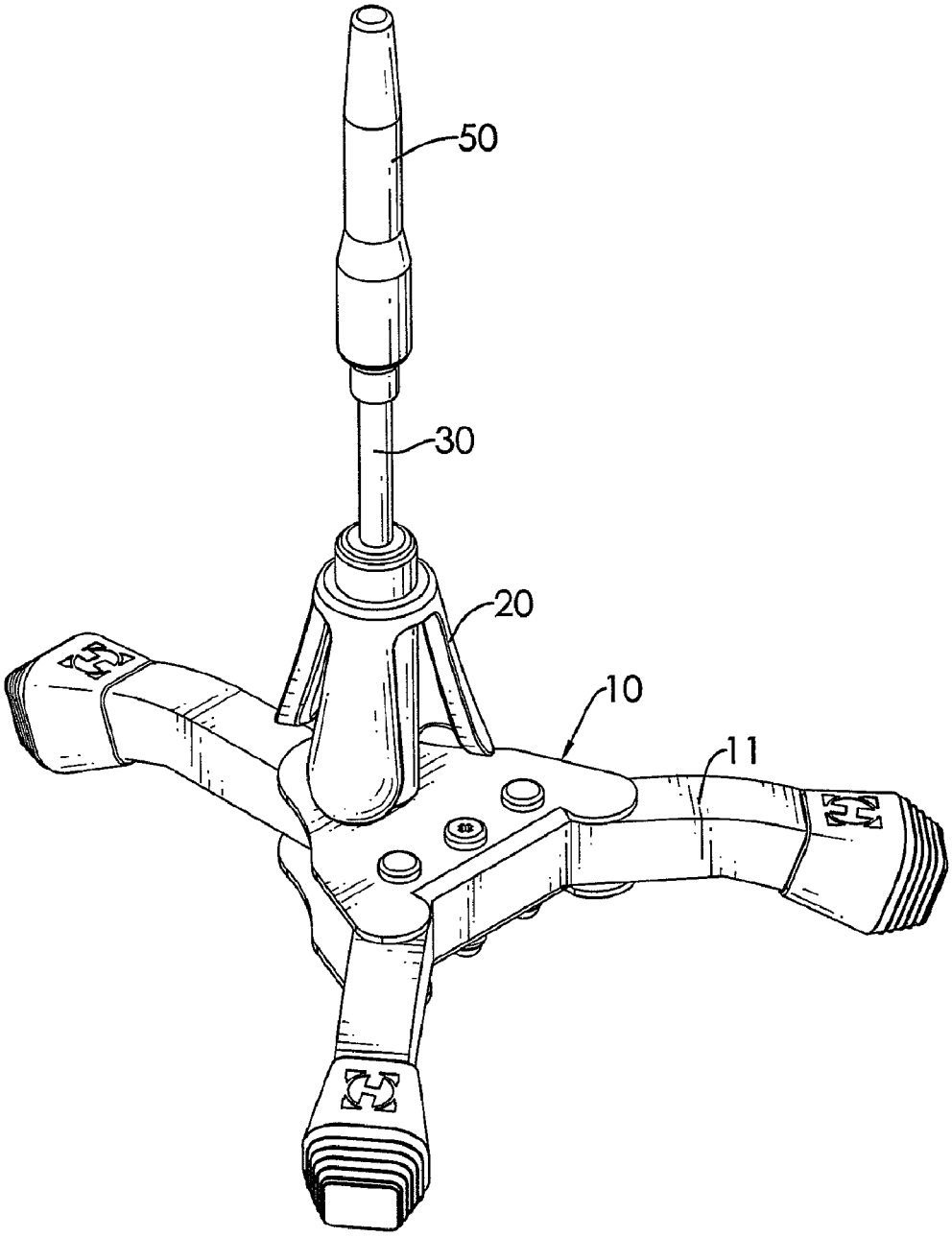
FIG. 2 is a perspective view of the supporting stand after assembly.

With reference to FIGS. 1 and 2, it is noted that the supporting stand in accordance with the present invention includes a base (10), a connection joint (20), a supporting rod (30), a compressible spring (40) and a conical covering (50).

The base (10) is composed of three legs (11) respectively and divergently extending out from a center of the base (10). With the three extending legs (11), the base (10) is able to securely stand on a plan surface. a bottom end of the connection joint (20) is securely and threadingly connected to the center of the base (10) and has a connection hole (21) defined in a top end thereof. The supporting rod (30) has a threaded bottom end which is threadingly inserted into the connection hole (21) of the connection joint (20). The supporting rod (30) has a stop flange (31) formed on an outer face of the supporting rod (30). A bottom end of the compressible spring (40) is securely mounted on the free end of the supporting rod (30).

Figure 3:
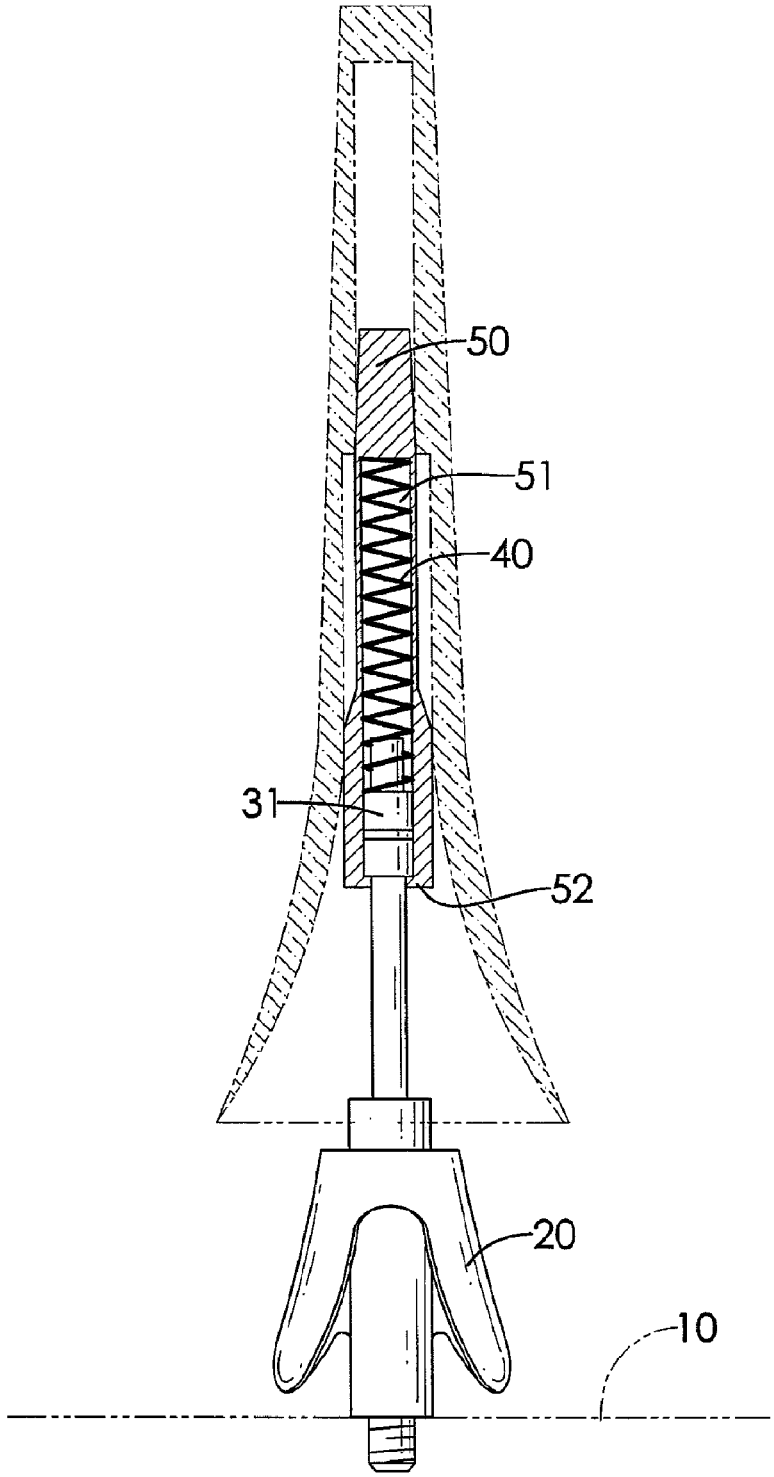
FIG. 3 is a schematically cross sectional view showing that a clarinet is to be combined with the supporting stand of the present invention.
Figure 4:
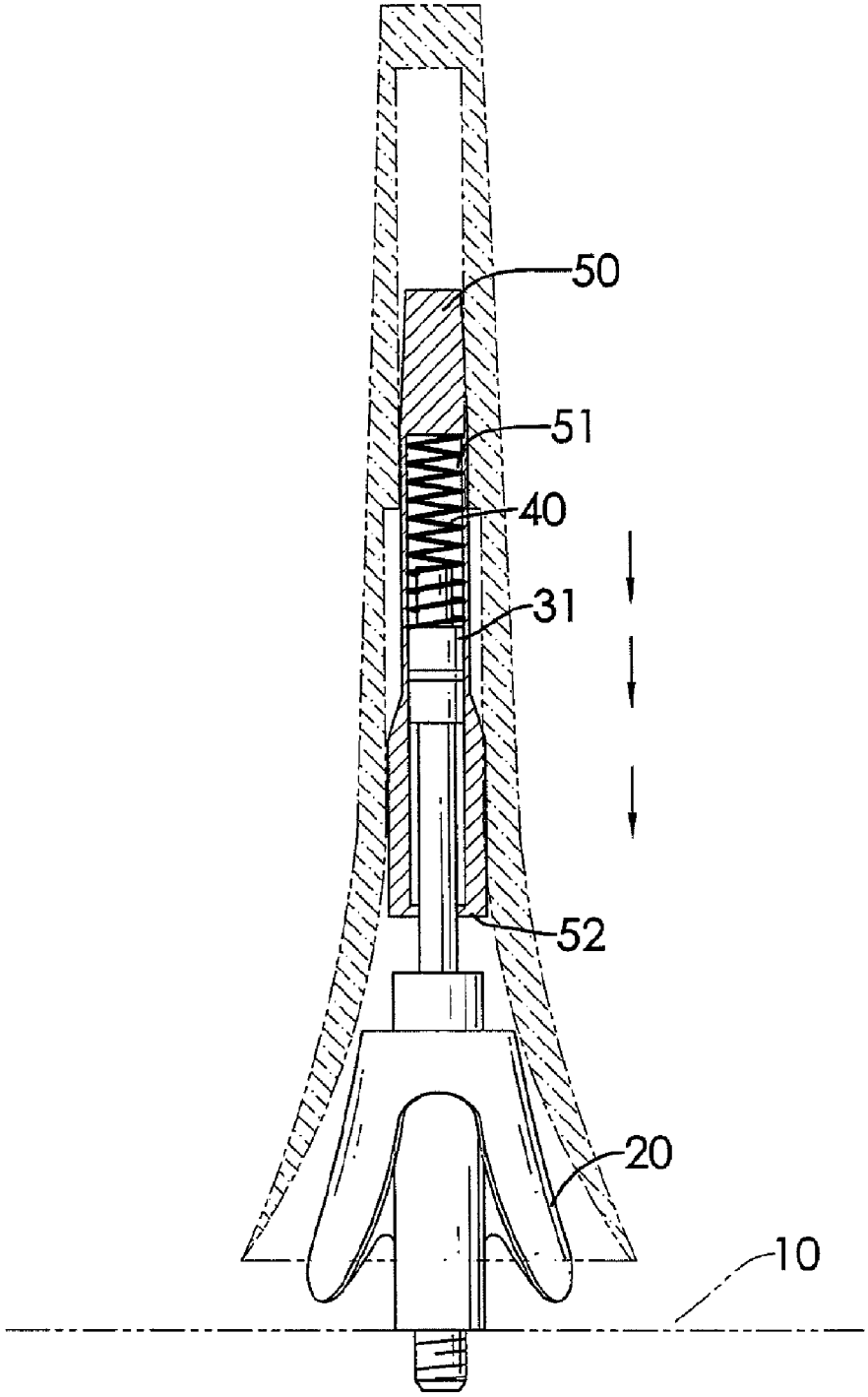
FIG. 4 is a schematic side plan view in cross section showing that the clarinet is mounted on top of the supporting stand of the present invention.

With reference to FIGS. 3 and 4, it is also noted that the conical covering (50) has a passage (51) defined inside the conical covering (50) to receive therein the compressible spring (40). Also, a flange (52) is formed on an inner face of the passage (51).

When the supporting stand of the present invention is assembled, it is noted that the bottom end of the connection joint (20) is connected to the center of the base (10) and the bottom end of the supporting rod (30) is inserted into the connection hole (21) to secure engagement between the supporting rod (30) and the connection joint (20). After the free end of the compressible spring (40) as well as a portion of the supporting rod (30) is inserted into the passage (51) of the conical covering (50), the flange (52) is provided to the inner face of the passage (51) to engage with a bottom face of the stop flange (31). The engagement of the flange (52) to a bottom face of the stop flange (31) prevents the conical covering (50) from detachment with the supporting rod (30). Meanwhile the free end of the compressible spring (40) abuts against a bottom face of the passage (51).

It is to be noted from the depiction that when a clarinet, for example, is to be supported by the supporting stand of the present invention, the conical covering (50) is inserted into the clarinet. Due to the outer diameter of the conical covering (50) being tapered, eventually the conical covering (50) engages with an inner face of the clarinet. Therefore, it is learned that the conical covering (50) is able to adapt to clarinet of different dimensions and the compressible spring (40) provides sufficient supporting force to the clarinet which is mounted on top of the conical covering (50). Especially, FIG. 4 shows that after the clarinet is mounted on top of the supporting stand of the present invention, the weight of the clarinet forces the conical covering (50) to move relative to the supporting rod (40), which compresses the compressible spring (40) inside the passage (51) of the conical covering (50). As a result, the supporting stand of the present invention is able to adapt to clarinet of different dimensions to provide sufficient supporting force thereto.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A supporting stand consisting essentially of:

a base composed of legs divergently extending out from a center thereof;

a connection joint firmly extending upward from the base and having a connection hole defined in a free end of the connection joint;

a supporting rod having a bottom end extending into the connection hole to secure engagement between the supporting rod and the connection joint;

a compressible spring mounted on a free end of the supporting rod; and a conical covering movably mounted on top of the supporting rod to sandwich the compressible spring therebetween such that the conical covering is able to adapt to and extend into musical instrument of different dimensions.

2. The supporting stand as claimed in claim 1, wherein the supporting rod has a stop flange formed on an outer face of the supporting rod and the conical covering has a flange formed on a face of the conical covering such that engagement of the flange to a bottom face of the stop flange prevents the conical covering from detachment with the supporting rod.

3. The supporting stand as claimed in claim 2, wherein the conical covering has a passage defined to receive therein the compressible spring.

* * * * *